United States Patent [19]

Hunt

[11] Patent Number: 4,852,663

[45] Date of Patent: Aug. 1, 1989

[54] HYDRAULIC PERCUSSIVE MACHINES

[75] Inventor: Clive W. Hunt, Malanshof, South Africa

[73] Assignee: The Steel Engineering Company Limited, Transvaal, South Africa

[21] Appl. No.: 127,240

[22] Filed: Dec. 1, 1987

Related U.S. Application Data

[63] Continuation of Ser. No. 840,867, Mar. 18, 1986, abandoned.

[30] Foreign Application Priority Data

Mar. 26, 1985 [ZA] South Africa ..... 85/2266

[51] Int. Cl.[4] ..... B23B 45/16

[52] U.S. Cl. ..... 173/134; 91/392

[58] Field of Search ..... 173/116, 134, 135, 138; 91/392, 397, 398

[56] References Cited

U.S. PATENT DOCUMENTS 3,701,386 10/1972 Feucht ..... 173/78

FOREIGN PATENT DOCUMENTS 3336540 4/1984 Fed. Rep. of Germany ..... 173/116
962456 9/1982 U.S.S.R. ..... 173/134
977752 11/1982 U.S.S.R. ..... 173/134

*Primary Examiner*—Frank T. Yost
*Assistant Examiner*—Willmon Fridie, Jr.
*Attorney, Agent, or Firm*—Wegner & Bretschneider

[57] ABSTRACT

The present invention is directed to a hydraulic percussive machine with a shuttle valve to control the flow of fluid to and from a drive chamber without timing lands on the piston and a seal between the drive and return chambers. This is made possible by the use of a restrictive orifice connected to the shuttle valve and the port in the return chamber which is covered and uncovered by the piston. When the port is uncovered, the shuttle valve moves over under pressure. When the port is covered, pressure leaks away to the orifice so that the shuttle valve moves back again.

4 Claims, 1 Drawing Sheet

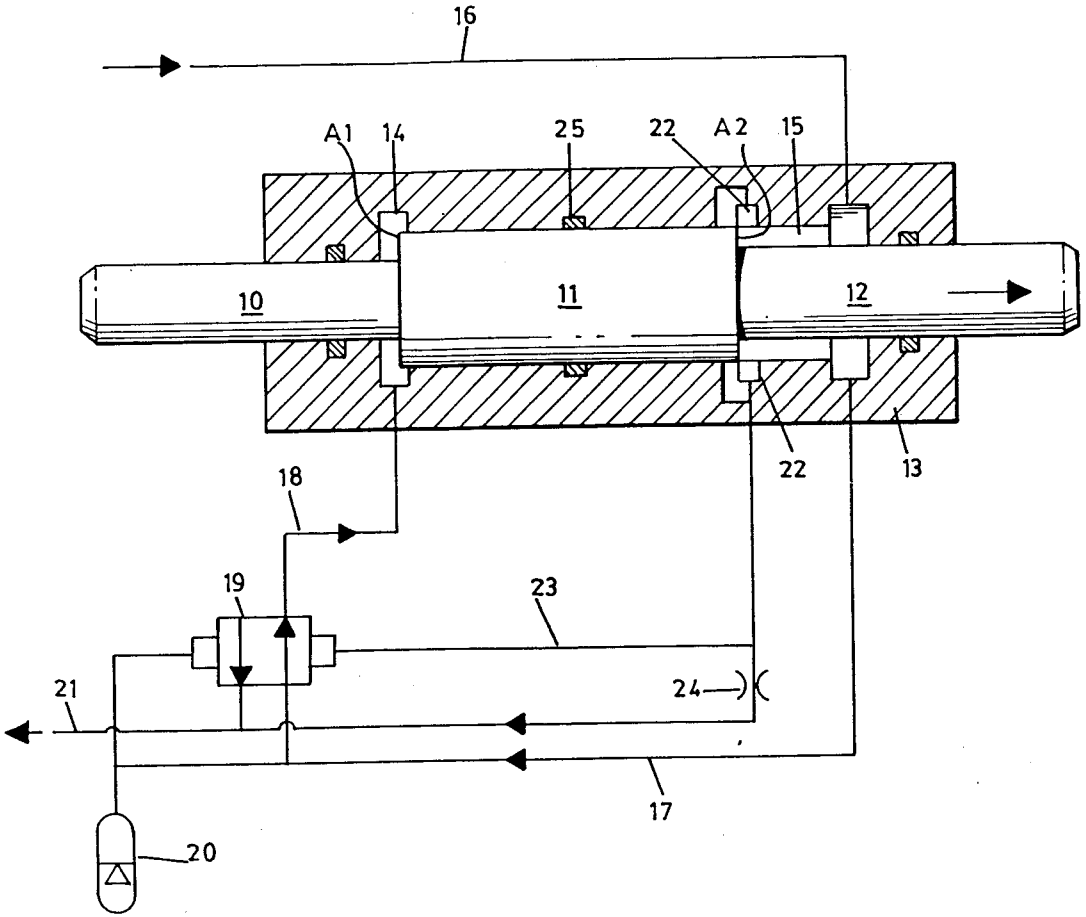
10
11
12
13
14
15
16
17
18
19
20
21
22
23
24
25
A1
A2

HYDRAULIC PERCUSSIVE MACHINES

This application is a continuation of U.S. application Ser. No. 840,867, filed Mar. 18, 1986, now abandoned.

BACKGROUND TO THE INVENTION

This invention relates to hydraulic percussive machines of the kind which can be used as rock drilling machines.

Hydraulic machines are known which work on the principle of differential piston areas operating in two working chambers. In such a case one chamber, usually the return chamber, is constantly at systems pressure, while the drive chamber exposed to the larger piston area is alternatively at systems pressure or connected to tank.

In one kind of machine a shuttle valve also having differential end areas is moved to an fro to connect the drive chamber to systems pressure and to tank in turn. Timing lands on the piston cover and uncover ports in the wall of the cylinder defining the chambers. Since the timing lands would wreak havoc with any seals intermediate the two chambers, truly effective sealing is not possible. One has to rely on the closeness of the fit of the piston in the cylinder.

SUMMARY OF THE INVENTION

According to the invention a hydraulic percussive machine comprises:

a cylinder, a piston which can reciprocate in the cylinder, a return chamber at one end of the cylinder, a drive chamber at the opposite end of the cylinder, faces on the piston exposed to the drive chamber and return chamber respectively with the face exposed to the drive chamber being the larger, means for connecting the return chamber to a source of hydraulic fluid under pressure, a shuttle valve for connecting and disconnecting the drive chamber to the source of high pressure and for connecting the drive chamber to an exhaust when the drive chamber is disconnected from the source, the shuttle valve having a plunger with first and second differential plunger areas the first and smaller of which is constantly connected to the source, a port in the return chamber which is uncovered when the piston moves on its return stroke and is covered when the piston moves on its working stroke, a connection between the port and the second differential plunger area, a restrictive orifice between exhaust and the second differential plunger area, and a seal in the cylinder around the piston between the return and drive chambers.

DESCRIPTION OF THE DRAWING

It is diagrammatic section of a reciprocating machine according to the invention.

DESCRIPTION OF AN EMBODIMENT

In the drawing a piston having a back end 10, a middle section 11 and a front end 12 moves in a cylinder 13. The cylinder 13 has a drive chamber 14 and a return chamber 15. The piston has annular areas A1 and A2 of which A1 is larger than A2 so that with the chambers 14 and 15 at the same pressure the piston is urged to the right.

A high pressure line 16 leads from a source of hydraulic fluid under pressure to the chamber 15. The chamber 15 is connected along lines 17 and 18 and a shuttle valve 19 to the chamber 14. The line 17 also leads to the left hand end of the valve 19 and the usual accumulator 20. A line 21 leading from the valve 19 drains to tank. From a pair of balanced ports 22 in the chamber 15 a line 23 leads to the right hand end of the valve 19. The line 23 is connected to the line 21 through a restrictive orifice 24.

The valve 19 has differential piston areas so that with its ends at the same pressure, the valve moves to the left to a position in which the line 17 is connected to the chamber 14. With the right hand end of the valve 19 at reduced pressure, the valve 19 moves to the right to connect the chamber 14 to tank.

The piston section 11 passes through a seal 25 which seals the chambers 14 and 15 from one another.

Starting from the illustrated position, the valve 19 is biased to the left to cause the chamber 14 to be pressurised. As a result the piston moves to the right on its working stroke. In so doing it obturates the port 22. The leak through the orifice 24 now depressurises the right end side of the valve 19 causing the valve 19 to connect the chamber 14 to tank. Pressure in the chamber 15 will now cause the piston to move to the left with the result that the port 22 is uncovered for a next stroke to take place.

The frequency and force of the piston blows can be regulated, inter alia, by choosing the correct opening for the restrictive orifice 24.

I claim:

1. A hydraulic percussive machine comprising:

a cylinder, a piston which can reciprocate in the cylinder, a return chamber at one end of the cylinder, a drive chamber at one end of the cylinder, faces on the piston exposed to the drive chamber and return chamber respectively with the face exposed to the drive chamber being the larger, means for connecting the return chamber to a source of hydraulic fluid under pressure, a shuttle valve for connecting and disconnecting the drive chamber to the source of high pressure and for connecting the drive chamber to a tank when the drive chamber is disconnected from the source, the shuttle valve having a plunger with first and second differential plunger areas, the first and smaller of which is constantly connected to a source, a port in the return chamber which is uncovered when the piston moves on its return stroke and is covered when the piston moves on its working stroke, a connection between the port and the second differential plunger area, and means for allowing fluid to slowly pass from the second differential plunger area to the tank when the port is covered by the piston, said means comprising a restrictive orifice between the tank and the second differential plunger area.

2. The machine claimed in claim 1 in which the drive chamber is connected to the source through the return chamber.

3. The machine claimed in claim 2 in which the first differential plunger area is connected to the source through the return chamber.

4. The machine claimed in claim 1, further comprising a seal in the cylinder around the piston between the return and drive chambers.

* * * * *